US008695415B2

(12) United States Patent
Veneruso et al.

(10) Patent No.: US 8,695,415 B2
(45) Date of Patent: Apr. 15, 2014

(54) CONTACT-LESS SENSOR CARTRIDGE

(75) Inventors: Anthony Veneruso, Sugar land, TX (US); Véronique Nouaze, Le Plessis Robinson (FR); Christian Chouzenoux, St. Cloud (FR); Eugene Janssen, La Celle Saint Cloud (FR); Frederic Pauchet, Montigny sur Loing (FR); Bernard Parmentier, Maurepas (FR); Sylvain Durisotti, Villejuif (FR); François Barbara, Sartrouville (FR); Philippe Parent, Orsay (FR); Lahcen Garando, Orsay (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 406 days.

(21) Appl. No.: 12/441,316

(22) PCT Filed: Sep. 13, 2007

(86) PCT No.: PCT/EP2007/059678

§ 371 (c)(1),
(2), (4) Date: Jul. 24, 2009

(87) PCT Pub. No.: WO2008/034761

PCT Pub. Date: Mar. 27, 2008

(65) Prior Publication Data

US 2010/0011853 A1 Jan. 21, 2010

(30) Foreign Application Priority Data

Sep. 20, 2006 (EP) ..... 06291480

(51) Int. Cl.
*E21B 47/01* (2012.01)
*E21B 47/12* (2012.01)

(52) U.S. Cl.
USPC ..... 73/152.52

(58) Field of Classification Search
USPC ..... 73/152.01, 152.02, 152.22, 152.46, 73/152.51, 152.52; 340/854.6, 854.8, 340/855.8
See application file for complete search history.

(56) References Cited

U.S. PATENT DOCUMENTS 3,732,728 A * 5/1973 Fitzpatrick ..... 73/152.52
3,905,010 A * 9/1975 Fitzpatrick ..... 340/854.4

(Continued)

FOREIGN PATENT DOCUMENTS

| | | |
|---|---|---|
| EP | 0919697 | 6/1999 |
| EP | 1046782 | 10/2000 |
| GB | 2396211 | 6/2004 |
| WO | 00/36386 | 6/2000 |

OTHER PUBLICATIONS

Examination Report for the equivalent EP patent application No. 06291480.9 issued on Mar. 10, 2009.

(Continued)

*Primary Examiner* — John Chapman, Jr.
(74) *Attorney, Agent, or Firm* — Cameron R. Sneddon

(57) ABSTRACT

The disclosure provides a sensor cartridge that includes a protective housing that is resistant to downhole oilfield environment; a sensor within the protective housing able to measure a parameter of the down-hole oilfield environment; an attaching device to interconnect with another sensor cartridge and/or a hub; a data communication unit within the protective housing, the data communication unit providing wireless communication of the measured parameter to the other sensor cartridge and/or the hub when interconnected with the other sensor cartridge and/or the hub; and a power unit within the protective housing, the power unit providing power supply to sensor and/or data communication unit.

22 Claims, 4 Drawing Sheets

(56) References Cited

U.S. PATENT DOCUMENTS

| | | | | |
|---|---|---|---|---|
| 6,075,461 | A | 6/2000 | Smith | |
| 6,538,576 | B1 | 3/2003 | Schultz et al. | |
| 6,567,006 | B1 * | 5/2003 | Lander et al. | 73/152.58 |
| 6,843,119 | B2 * | 1/2005 | Patey et al. | 73/152.18 |
| 6,943,697 | B2 * | 9/2005 | Ciglenec et al. | 340/853.1 |
| 2002/0149498 | A1 | 10/2002 | Tabanou et al. | |
| 2004/0238165 | A1 | 12/2004 | Salamitou et al. | |
| 2005/0200498 | A1 * | 9/2005 | Gleitman | 340/854.4 |
| 2006/0005965 | A1 | 1/2006 | Chouzenoux et al. | |

OTHER PUBLICATIONS

Written Opinion of International Search Authority for the equivalent PCT patent application No. PCT/EP2007/059678 issued on May 31, 2010.

Examiner's Report for the equivalent Canadian patent application No. 2663923 issued on Sep. 10, 2013.

* cited by examiner

CONTACT-LESS SENSOR CARTRIDGE

FIELD OF THE INVENTION

The present invention broadly relates to electronics, sensors and wireless communication. More particularly the invention relates to a sensor cartridge to use in an oilfield environment, preferably in a well, in downhole severe conditions.

DESCRIPTION OF THE PRIOR ART

The monitoring of downhole conditions with permanently deployed sensors can be used to optimize oil and gas production. The packaging technology commonly used today for these sensors systems (notably, pressure sensors) is based on separation of the functions in the sensor system in three sub-systems. In a first sub-system, a first vessel containing the sensing part or sensor, as such, is in contact with the environment (in general high pressure for downhole application). This first vessel is composed of a feed-through, a cavity containing the sensor filled with oil and an oil volume compensated device (in general a bellows or a flexible membrane) for oil dilatation/contraction. In a second sub-system, a second vessel contains the electronics that does not see the external pressure. Generally the second vessel is filled with an inert gas or is under vacuum and is designed to withstand high pressure. In a third sub-system, a third vessel contains a power and communication part which is in direct contact with the external environment, and which requires again a pressure barrier between the electronics and the power/communication function. This packaging technology work fine but cost of the final system is not competitive enough when it is required to deploy a large number of disposable sensor systems downhole in many places to control valves, pumps, other production hardware or the formation parameters.

U.S. Pat. No. 6,075,461 describes an apparatus, method and system for communicating information between downhole equipment and surface equipment. The electromagnetic signal repeater apparatus comprises a housing that is securably mountable to the exterior of a pipe string disposed in a wellbore. The housing includes first and second housing subassemblies. The first housing subassembly is electrically isolated from the second housing subassembly by a gap subassembly having a length that is at least two times the diameter of the housing. The first housing subassembly is electrically isolated from the pipe string and is secured thereto with a nonconductive strap. The second housing subassembly is electrically coupled with the pipe string and is secured thereto with a conductive strap. An electronics package and a battery are disposed within the housing. The electronics package receives, processes and retransmits the information being communicated between the downhole equipment and the surface equipment via electromagnetic waves.

Effectively, the key drawbacks of conventional sensor systems is that they require relatively expensive high pressure packaging and one or more bulkhead feed-throughs. A first bulkhead is needed because the sensing part must be exposed to the pressure environment and its associated electronics must be packaged within an atmospheric chamber. The second bulkhead feed-through is needed to connect the sensor system to the outside world.

The present invention proposes a novel system architecture allowing reducing size of the packaging as well as cost of the overall sensors systems without degrading system performances but improving reliability.

SUMMARY OF THE INVENTION

The invention discloses a sensor cartridge comprising: (a) a protective housing, the protective housing being resistant to downhole oilfield environment; (b) a sensor within the protective housing able to measure a parameter of the downhole oilfield environment; (c) an attaching means to interconnect with another sensor cartridge and/or a hub; (d) a data communication unit within the protective housing, the data communication means providing wireless communication of the measured parameter to the other sensor cartridge and/or the hub when interconnected with the other sensor cartridge and/or the hub; and (e) a power unit within the protective housing, the power unit providing power supply to sensor and/or data communication unit. The major advantage of the sensor cartridge according to the invention is that the two bulkhead feed-throughs are suppressed.

Preferably, the sensor, the data communication unit and the power unit are exposed to the same pressure within the protective housing. The advantage of this configuration allows also a suppression of further feed-throughs within the protective housing.

The wireless data communication can be an electromagnetic communication and/or a pressure waves communication. The wireless power transfer can be done via inductive coupling. Also, the power unit can be a power storage unit, as for example a rechargeable battery. Further, the sensor cartridge can comprise a micro-controller and/or memory unit for storing the measured parameter. The attaching means can be any one taken in the list constituted of: fixing, attaching, screwing, hanging, sticking, crimping, and hoping. Preferably, the protective housing is a non-metallic housing and/or filled with a material.

In a second embodiment, the invention discloses a sensor cartridge comprising: (a) a protective housing, the protective housing being resistant to downhole oilfield environment; (b) a sensor within the protective housing able to measure a parameter of the downhole oilfield environment; (c) an attaching means to interconnect with another sensor cartridge and/or a hub; and (d) a power/data unit within the protective housing, the power/data unit providing wireless power transfer and wireless data communication of the measured parameter to the other sensor cartridge and/or the hub when interconnected with the other sensor cartridge and/or the hub. Preferably, the power/data unit is an antenna communicating data and power via inductive coupling.

In a third embodiment, the invention discloses a sensor cartridge comprising: (a) a protective housing, the protective housing being resistant to downhole oilfield environment; (b) a sensor within the protective housing able to measure a parameter of the downhole oilfield environment; and (c) an attaching/power/data unit within the protective housing, the attaching/power/data unit interconnecting with another sensor cartridge and/or a hub, providing wireless power transfer and wireless data communication of the measured parameter to the other sensor cartridge and/or the hub when interconnected with the other sensor cartridge and/or the hub. The attaching/power/data unit can be a solenoid antenna communicating data and power via inductive coupling and attaching via magnetic field. The attaching/power/data unit can be a half-toroïdal antenna.

The sensor cartridge can further comprise a coupling means for better measuring the parameter of the downhole oilfield environment by the sensor. For example it can be a flexible material, as rubber membrane.

The sensor cartridge can further comprise a coupling means for providing fluid communication between the sensor and a fluid of the downhole oilfield environment.

In another aspect of the invention, a system is disclosed using a sensor cartridge as above, comprising further a hub able to interconnect with the sensor cartridge through an attaching means and to communicate data through a data communication unit. Preferably, the system is further able to transfer power through a power transfer unit and/or further comprises a wire cable for data and/or power transfer.

Still, in another aspect of the invention, a network of those systems is disclosed able to monitor a formation and/or a well property.

BRIEF DESCRIPTION OF THE DRAWING

Further embodiments of the present invention can be understood with the appended drawings.

DETAILED DESCRIPTION

The invention consists of a low-cost wireless pressure sensor with integrated electronics for use in a down-hole environment. Power and communication are provided through an incorporated battery and/or via wireless interface that is accessible on both sides of the cartridge to allow for easy combination of multiple sensor cartridges. The sensor cartridge can be lowered in a well, for period measurements (non permanent application) or for permanent measurements (permanent monitoring application), and alternatively the sensor cartridge can be mounted at completion stage directly within the well. The well comprises conventionally, a casing isolating a formation from the inside of the well, a production tubing inside the casing for recovery of the oil to the surface and various equipment within ensuring control and/or support of the production (valve, packer, . . . ). The sensor cartridge can be located so the surrounding environment allows measurement of a property of a fluid within the well (mud, oil/water/gas), or a property of a solid (formation, casing, tubing or any piece of equipment).

Figure 1:
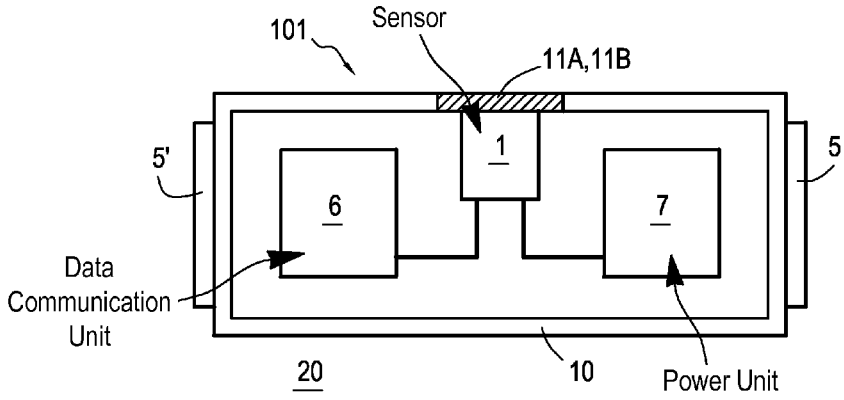
FIG. 1 shows a sensor cartridge according to the invention in a first embodiment.
Figure 3A:
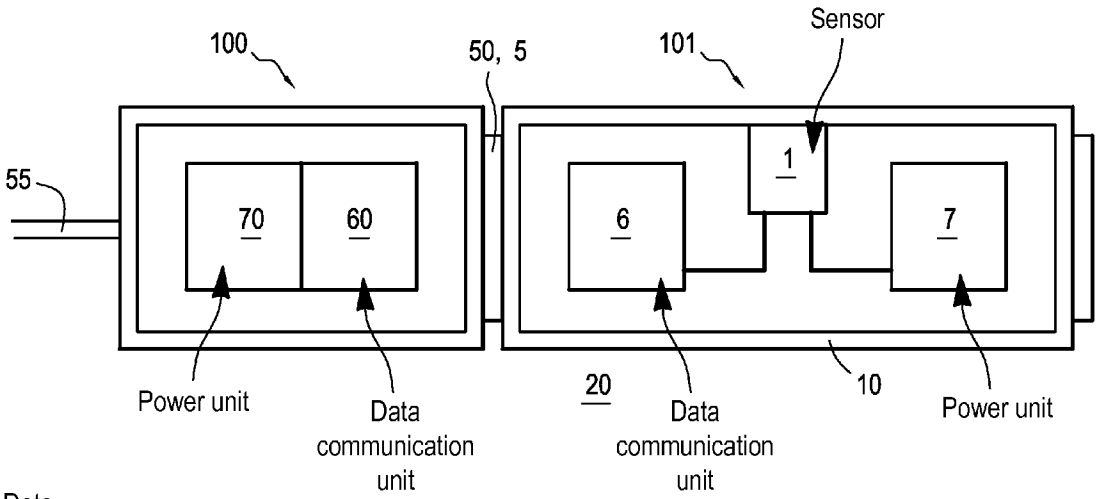
FIG. 3A shows the interconnection of the sensor cartridge with another sensor cartridge.
Figure 3B:
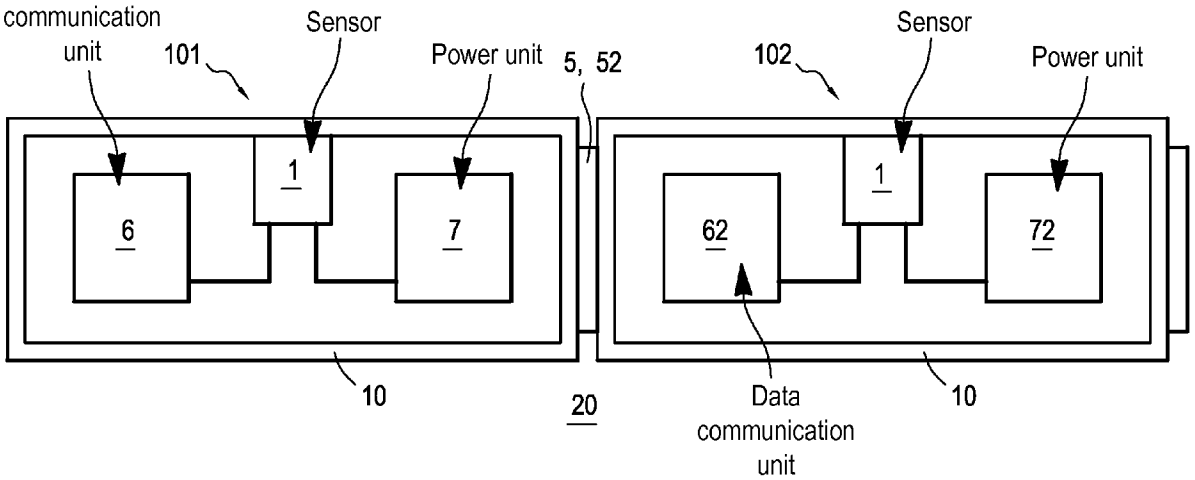
FIG. 3B shows the interconnection of the sensor cartridge with a hub.

In a first embodiment, the sensor cartridge 101 according to the invention comprises a protective housing 10, a sensor (as such) 1, also called a sensing part to measure a parameter of the surrounding environment, a data communication unit 6, a power unit 7 and an attaching means 5 to interconnect with another sensor cartridge 102 and/or with a master or host hub 100. FIG. 1 presents the general sketch of the sensor cartridge and FIGS. 3A and 3B represent the interaction of the sensor cartridge with another sensor cartridge (3B) or with a hub (3A).

Various types of sensors and technology can be implemented in the sensor cartridge. Sensors can measure properties from the downhole fluid in the formation or formation itself or alternatively properties from the well infrastructure as casing or tubing, or even alternatively properties from fluid inside the well; combination of several sensors measuring various properties is also possible. Such sensors can, for example, measure the fluid pressure or velocity inside the well or measure the surrounding formation fluid pressure, temperature, resistivity, salinity or detect the presence of chemical components such as $CO_2$ or $H_2S$, the sensors can also be applied to measure casing or tubing properties such as corrosion, strain and stress. As example, the following types of sensors can be implemented:

Pressure and temperature,
Resistivity (or conductivity),
Gamma ray, X-ray,
Casing and Tubing stress or strain,
Flow rates, fluid density,
pH of surrounding fluids,
Chemical content such as $CO_2$ and $H_2S$ monitoring.

The data communication unit 6 provides wireless communication between components within the protective housing and the outside world i.e. surrounding environment. Effectively, the protective housing being sealed, and feed-through between electronics inside and outside wanting to be avoided, wireless communication ensures data transfer. As it is understood, the data communication unit does not need to have a long rang of transmission, the data communication unit should only be able to communicate in the immediate vicinity of the protective housing. The sensor cartridge is interconnected with the other sensor cartridge and/or with the master hub and should only be able to communicate with the other sensor cartridge and/or with the master hub. Therefore, the range of communication of the data communication unit is at most of 20 centimeters and preferably of some centimeters, preferably less than 5 centimeters. The wireless communication can be done via electromagnetic waves and/or via pressures waves. So, the data communication unit can be an electromagnetic generator, in a first embodiment the electromagnetic generator is an optic generator, preferably of the type IR, visible light or UV emitter, in a second embodiment the electromagnetic generator is a radio waves generator, preferably of the type antenna or the data communication unit can be a transducer producing sonic waves, preferably of the type ultrasonic transducer.

The power unit 7 provides power supply to components within the protective housing needing supply. The power unit in a first embodiment can be a power storage unit of the type rechargeable battery or non-rechargeable battery. The power unit in a second embodiment can be a means ensuring wireless power transfer between inside of the protective housing and the outside world i.e. surrounding environment.

The protective housing ensures protection between components within the protective housing and the outside world i.e. surrounding environment. The protective housing is a housing which is sealed against surrounding environment. The protective housing is resistant to downhole oilfield environment and therefore, is able to resist to corrosion, to downhole temperature and to downhole pressure. Two types of configuration are possible, in a first type of configuration a non metallic housing is used to avoid any screened room effect, such first type of configuration is preferable when data communication unit uses electromagnetic waves for communication (radio waves, . . . ). A contrario, in a second type of configuration a metallic housing is used to allow the screened room effect, such second type of configuration is preferable when data communication unit uses acoustic or optic communication. The metallic housing can further be covered by a coating protecting against corrosion. The geometry of the protective housing is not a predominant factor (apart when screened room effect is sought and when a certain geometry has to be used), however useful designs are preferable. So protective housing is preferably, a cylinder which can be easily interconnected with another cylinder.

The attaching means 5 ensure interconnection of the sensor cartridge with the other sensor cartridge and/or the master or host hub. The attaching means can be any type of system to ensure fixed contact with the two elements, fixing, attaching, screwing, hanging, sticking, crimping, or hooping can be used. Magnetic forces to ensure fixed contact can also be used: so the attaching means is a magnet. The attaching means can ensure a permanent contact or a removable contact. The attaching means can be within the protective housing, on the protective housing or integrated in the protective housing, depending of its nature.

The other sensor cartridge 102 interconnecting with the sensor cartridge 101 can be a sensor cartridge of the same type as disclosed above, or of a type slightly or totally different depending on the alternatives chosen for the sensor cartridge. However, importance is to ensure interoperability with the both sensor cartridges i.e. both data communication units (6, 62) should communicate between them, both attaching means (5, 52) should ensure contact, power unit (7, 72) should ensure power supply in both compartments.

The hub 100 interconnecting with the sensor cartridge 101 is a unit which is able to communicate with the sensor cartridge through wireless data transfer via a data communication unit 60, which is able to provide power supply through wireless power transfer via a power unit 70 if needed and which is able to interconnect with the sensor cartridge via the attaching means 50. The hub can be a master hub which is connected to surface through a wire connection 55 and ensures good functioning of the sensor cartridge 101. Or the hub can be a host hub which ensures storage of the data and power supply if needed and is retrievable from the well.

Figure 2A:
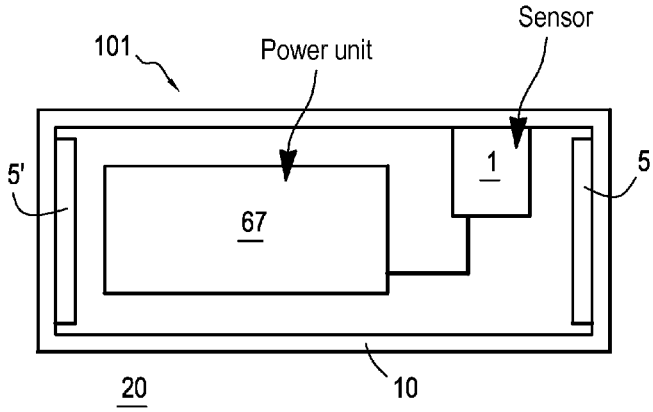
FIG. 2A shows a sensor cartridge according to the invention in a second embodiment.

In a second embodiment, the sensor cartridge 101 according to the invention comprises a protective housing 10, a sensor 1 to measure a parameter of the surrounding environment, a data communication and power unit 67 and an attaching means 5 to interconnect with another sensor cartridge 102 and/or with a master or host hub 100. FIG. 2A presents the general sketch of the sensor cartridge according to the second embodiment and FIGS. 3A and 3B represent the interaction of the sensor cartridge with another sensor cartridge (3B) or with a hub (3A).

In this second embodiment, the data/power unit provides wireless data transfer but also wireless power transfer. The data/power unit is an inductive coupling antenna providing power transfer and data transfer via inductive coupling.

Figure 2B:
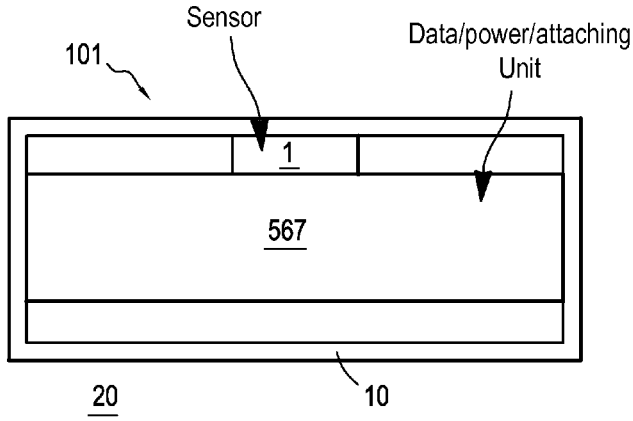
FIG. 2B shows a sensor cartridge according to the invention in a third embodiment.

In a third embodiment, the sensor cartridge 101 according to the invention comprises a protective housing 10, a sensor 1 to measure a parameter of the surrounding environment, and a data/power/attaching unit 567 to interconnect with another sensor cartridge 102 and/or with a master or host hub 100. FIG. 2B presents the general sketch of the sensor cartridge according to the third embodiment and FIGS. 3A and 3B represent the interaction of the sensor cartridge with another sensor cartridge (3B) or with a hub (3A).

In this third embodiment, the data/power/attaching unit provides wireless data transfer and wireless power transfer, but also ensures the function of the attaching means through the use of magnetic forces. The data/power/attaching unit is an inductive coupling antenna providing power transfer and data transfer via inductive coupling, and attaching function via magnetic coupling.

Further electronics can also be added to the sensor cartridge, for example a micro-controller and memory unit. The sensor cartridge measures data and stores those ones in the memory unit, the micro-controller ensures function of the sensor cartridge through various predefined programs; for example measuring the parameter via a defined cycle, storing the data in the memory and uploading the stored data on surface when needed. Alternatively, the micro-controller can be a reprogrammable micro-controller.

In a preferred embodiment, the sensor cartridge comprises a coupling means 11A for better sensing the parameter of the downhole oilfield environment by the sensor. Effectively as the protective housing is usually embodied to protect the components within, it can appear that certain type of sensor can not measure the parameter of the downhole oilfield environment because "too protected" behind the housing (for example a pressure sensor). Therefore, for example the coupling means 11A is made of a more flexible material or more reactive material to ensure coupling between the parameter of the downhole oilfield environment and the sensor. For example, if a pressure sensor is used, the coupling means 11A will be a rubber membrane in a rubber molding; if a gamma sensor is used, the coupling means 11A will be a low atomic number material (boron for example).

In other preferred embodiment, the sensor cartridge comprises a coupling means 11B for providing fluid communication between the sensor and a fluid or the fluids of the formation. Coupling element can be a chamber filled with a material selected for it high permeability in order to transmit the hydraulic pressure from the surrounding fluids to the pressure gauge. Also, the pore size distribution of the material pore can be optimized so that the particles of the formation will not penetrate inside the material.

A key advantage of the sensor cartridge technology is the facility to provide a simple design without complicated architecture and connections, thereby reducing cost and complexity while improving reliability and applicability. Effectively, material used are common material and do not ask for complicated and/or expensive technology, also material are easily assembled, preferably by molding. Reliability is improved because feed-throughs are avoided and applicability because the sensor cartridge resist to more severe environment.

One other key advantage of the sensor cartridge technology is the possibility to reduce considerably the size of the cartridge by miniaturization. The sensor cartridge can have a length below fifty centimeters, of some centimeters and even less than one centimeter. Effectively, sensor can be of the type MEMS and electronics used inside the cartridge can be of the type low or very-low power electronics. Thanks to the use of low or very-low power electronics, when the sensor cartridge is used with direct power supply (rechargeable battery or non rechargeable battery) the small amount of power stored in the battery ensures power supply of all components within the sensor cartridge and when the sensor cartridge is used with indirect power supply (wireless power transfer), this wireless power transfer is enough to ensure requirements in term of electrical consumption of all components within the sensor cartridge.

The sensor cartridge according to the invention can be used to monitor formation or well properties in various domains, such as:

Oil and Gas Exploration and Production,
Water storage,
Gas Storage,
Waste underground disposal (chemicals and nuclear).

In a fourth embodiment, the sensor cartridge can be embodied within another functional element. Effectively, the sensor cartridge can be a part of a bigger system using the sensor cartridge according to the invention, interest of embodying the sensor cartridge in this bigger system is to avoid feed-through and ensure a perfect protection of the sensor within the bigger system.

As several sensor cartridges can be used to interconnect together, a network of sensor cartridges can be realized using further different types of sensors. A network in series can be realized by interconnecting each sensor cartridge to each other, or a network in parallel can be realized by using a cable with multiple connections going to further different hubs. For example, a network with three different sensor cartridges can be realized by using: a pressure sensor cartridge, a temperature pressure sensor cartridge and a carbon dioxide pressure sensor cartridge. Aim of the network will be to measure successively temperature, pressure and $CO_2$ concentration within the well. For reliability reasons, sensor cartridge can be duplicated. The advantage of the network sensor cartridges is the interoperability and manageability.

Figure 4A:
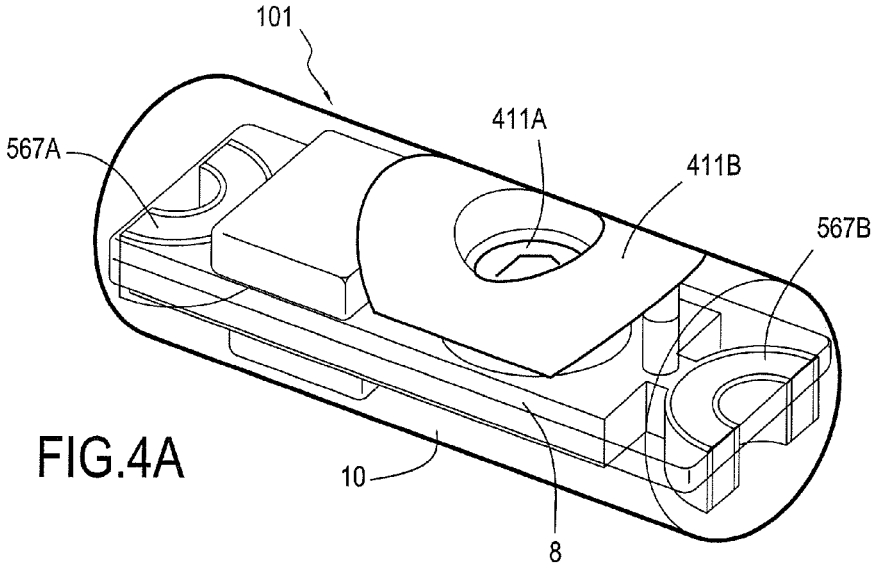
FIG. 4A shows the sensor cartridge in a preferred embodiment.
Figure 4B:
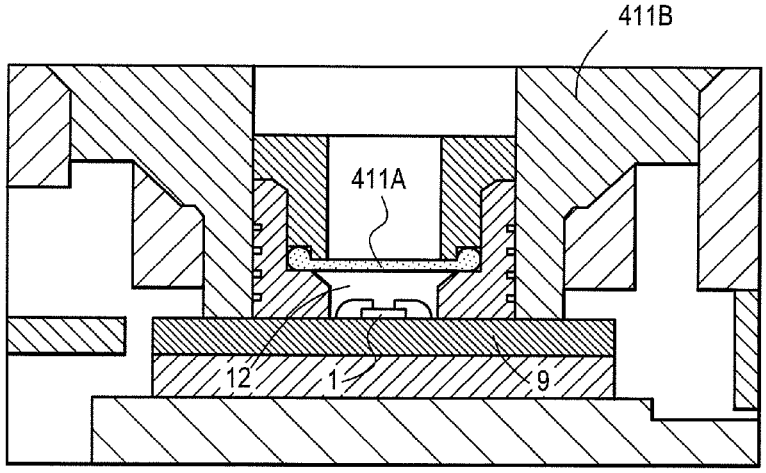
FIG. 4B shows a detail view of the pressure sensor of FIG. 4A.

FIGS. 4A and 4B show the sensor cartridge according to the invention in the preferred embodiment. The sensor cartridge 101 consists of a low-cost wireless pressure sensor 1 with integrated electronics (not shown) for use in a downhole environment. Power and communication are provided through a wireless interface (567A, 567B) that is accessible on both sides of the sensor cartridge to allow for easy combination of multiple sensor cartridges. All electronics are exposed to the ambient pressure, the sensor cartridge has a non-metallic housing 10, and all internal components, except for the pressure sensor 1, are molded inside. A low-cost rubber membrane 411A sustained by a rubber molding 411B transmits the external pressure to a small volume of oil 12 that fills the area around the pressure sensor 1 mounted on a ceramic substrate 9.

Figure 5A:
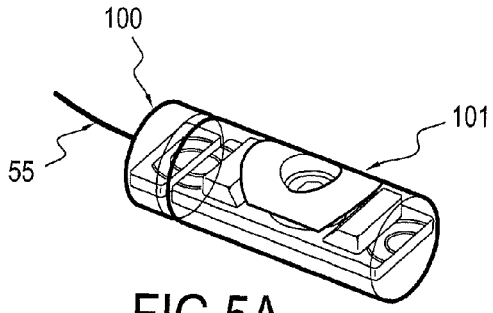
FIGS. 5A to 5C shows network of sensor cartridges.
Figure 5B:
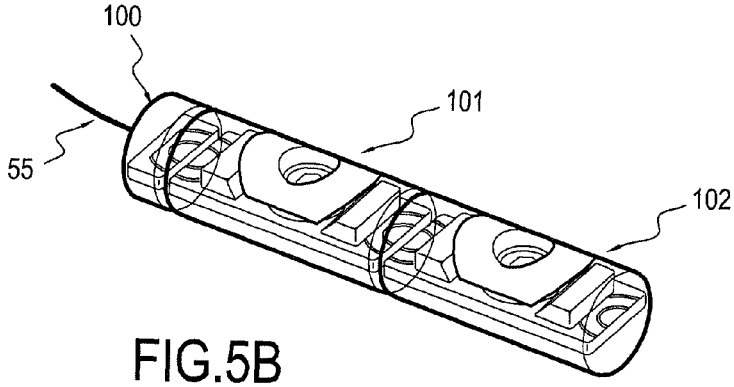
Figure 5C:
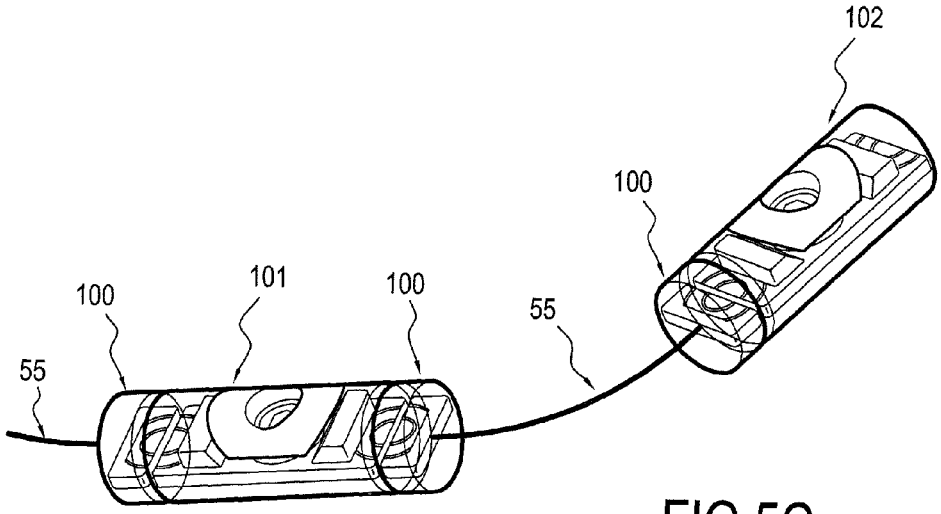

The wireless interface providing power and communication is made of half-toroïdal antenna. The half-toroïdal antennae are located at both ends of the sensor cartridge allowing flexible connection of several sensor cartridges and/or hubs in series. FIG. 5A to 5C show various possible configurations of network of sensor cartridges, when two sensor cartridges (or sensor cartridge and hub) interconnects, two half-toroidal antennae form a transformer which can pass data and power. Transformer efficiency will mainly depend on the gap between the two antennae, which is determined by twice the thickness of each protective housing 10. A better coupling can be provided by an optimized magnetic core design. Depending on the magnetic coupling of each set of antenna, the turns ratio is chosen to maintain a mostly constant voltage level across a series of sensor cartridges.

The oil volume around the pressure sensor is reduced to an absolute minimum volume by filling the entire sensor cartridge, for example with an inert material as epoxy. Only a small volume around the sensor is filled with oil which serves to transmit the external pressure to the pressure sensor. The flexible membrane, which can be made out of rubber, or alternatively a thin metal diaphragm, seals the oil inside the cartridge, and transmits the external pressure to the sensor. FIG. 3B shows in more details the implementation of this principle. Protection against the corrosive down-hole environment is provided by the non-metallic housing 10, which can consist of PEEK, and the rubber molding 411B. All internal components within the sensor cartridge are exposed to ambient pressure, eliminating the need for expensive bulkhead connectors and wire feed-throughs.

Bi-directional communication can be provided for example by using FSK modulation of the AC signal applied to the primary antenna, and impedance modulation at the level of each individual sensor cartridge. Each message can contain an address, so that each sensor cartridge can be addressed individually. Each sensor cartridge decodes the FSK signal, and only responds if the message has the correct address.

In another aspect of the invention, the sensor cartridge according to the invention uses a system of packaging which uses the integration of all functions into one pressurized vessel filled with oil and/or the filling of the pressurized vessel with gel, peek or ceramic to minimize oil volume expansion/contraction allowing to minimize the size of the compensation apparatus (in general made of a bellows). The minimization of oil volume to be put in the pressurized vessel containing sensor and electronics is important to avoid having a long bellow for oil volume dilatation/contraction when exposed to pressure and temperature variations. Also, the complete sensor system can be miniaturized. In that case, mixed solutions are proposed: gel filling of the pressurized cavity, glass balls mixed with oil, and ceramic/peek type housing fitting the shape of the sensor and electronics assembly.

The invention claimed is:

1. A sensor cartridge comprising:

a protective housing, said protective housing being resistant to a downhole oilfield environment, said protective housing having a first end and a second end, each of the first end and the second end does not include a feed-through;

a sensor within said protective housing to measure a parameter of the downhole oilfield environment;

a first attaching device on the first end and a second attaching device on the second end, each of the first and second attaching devices to magnetically couple the respective ends of the cartridge to a second cartridge or a hub;

a data communication unit within said protective housing, said data communication unit to communicate wirelessly said measured parameter between the cartridge and the second cartridge or the hub; and a power unit within said protective housing, said power unit to provide power to the sensor or the data communication unit.

2. The sensor cartridge of claim 1, wherein the sensor, the data communication unit and the power unit are exposed to the same pressure within the protective housing.

3. The sensor cartridge of claim 1, wherein the data communication unit is to provide electromagnetic communication.

4. The sensor cartridge of claim 1, wherein the data communication unit is to provide pressure waves communication.

5. The sensor cartridge according to claim 1, wherein said data communication unit and said power unit are embodied within a same data/power unit.

6. The sensor cartridge of claim 5, wherein said data communication unit and said power unit comprise an antenna to communicate data and power via inductive coupling.

7. The sensor cartridge of claim 1, wherein said data communication unit, said power unit and at least one of said first attaching device or said second attaching device is embodied within a same data/power/attaching unit.

8. The sensor cartridge of claim 7, wherein said data communication unit, said power unit and at least one of said first attaching device or said second attaching device comprise an antenna for communicating data and power via inductive coupling and mechanically coupling the respective first end or second end of the cartridge to the second cartridge or the hub via a magnetic field created by the antenna.

9. A sensor cartridge comprising:

a protective housing, said protective housing being resistant to a downhole oilfield environment;

a sensor within said protective housing to measure a parameter of the downhole oilfield environment;

an attaching device to interconnect with another sensor cartridge or a hub;

a data communication unit within said protective housing, said data communication unit providing wireless communication of said measured parameter to said another sensor cartridge and/or said hub when interconnected with said another sensor cartridge or said hub;

a power unit within said protective housing, said power unit providing power supply to the sensor or the data communication unit, wherein said data communication unit, said power unit and said attaching means are embodied within a same data/power/attaching unit and wherein said data communication unit, said power unit and said attaching means are a half-toroidal antenna communicating data and power via inductive coupling and attaching via magnetic field.

10. The sensor cartridge according to claim 1, wherein the power unit comprises a power storage unit.

11. The sensor cartridge of claim 10, wherein the power storage unit comprises a rechargeable battery.

12. The sensor cartridge according to claim 1, wherein the sensor includes a coupling device for measuring the parameter of the downhole oilfield environment.

13. The sensor cartridge of claim 12, wherein the coupling device comprises a flexible material.

14. The sensor cartridge according to claim 1, wherein the sensor includes a coupling device for providing fluid communication between the sensor and a fluid of the downhole oilfield environment.

15. The sensor cartridge according to claim 1, wherein the protective housing comprises a non-metallic material.

16. The sensor cartridge according to claim 1, wherein the protective housing is filled with a material.

17. The sensor cartridge according to claim 1, wherein the sensor is part of a network of similar sensors for monitoring a formation or a well property.

18. A system of sensor cartridges comprising:

a first sensor cartridge comprising:

a protective housing, said protective housing being resistant to a downhole oilfield environment, said protective housing having a first end and a second end, each of the first end and the second end is devoid of a passage therethrough;

a sensor within said protective housing to measure a parameter of the downhole oilfield environment;

a first magnetic attaching device on each of the first end and the second end to couple each of the respective ends to another cartridge or a hub;

a data communication unit within said protective housing, said data communication unit providing wireless communication of said measured parameter between the cartridge and the other cartridge or the hub; and a power unit within said protective housing, said power unit providing power to the sensor or the data communication unit; and a second sensor cartridge comprising:

a second protective housing, said second protective housing being resistant to the downhole oilfield environment;

a second sensor within said second protective housing to measure a parameter of the downhole oilfield environment;

a second magnetic attaching device on one end of the second protective housing, the second magnetic attaching device to couple the second sensor cartridge to one of the first end or the second end of the first cartridge;

a second data communication unit within said second protective housing, said second data communication unit providing wireless communication of said measured parameter between the second sensor cartridge and one or more of another cartridge or the hub; and a second power unit within said second protective housing, said second power unit providing power to the second sensor or the second data communication unit.

19. A system of sensor cartridges, comprising:

a plurality of sensor cartridges, each of the cartridges configured for use in a downhole environment and devoid of electrical feed-throughs, wherein at least some of the sensor cartridges include magnetic attachment devices having antennas to mechanically couple the sensor cartridges to each other via a magnetic field and to enable communications therebetween.

20. The system of claim 19, wherein the communications are implemented via electromagnetic waves or acoustic waves.

21. The system of claim 19, wherein the communications only travel less than about twenty centimeters.

22. The system of claim 19, wherein each of the magnetic attachment devices also provides data communication and power communication via an inductive coupling antenna.

* * * * *